United States Patent [19]

Vogel et al.

[11] 4,075,793

[45] Feb. 28, 1978

[54] POWER SANDER

[75] Inventors: Eberhard Vogel, Dettenhausen; Herbert Glaser, Leinfelden; Albert Kleider, Waldenbuch; Klaus Dietz, Musberg, all of Germany

[73] Assignee: Robert Bosch GmbH, Stuttgart, Germany

[21] Appl. No.: 664,808

[22] Filed: Mar. 8, 1976

[30] Foreign Application Priority Data

Mar. 15, 1975 Germany ..... 2511392

[51] Int. Cl.[2] ..... B24B 23/00

[52] U.S. Cl. ..... 51/170 TL; 51/170 MT

[58] Field of Search ..... 51/170 TL, 170 MT, 170 R, 51/386; 269/236, 254 R; 24/250, 252, 253

[56] References Cited

U.S. PATENT DOCUMENTS

| | | | |
|---|---|---|---|
| 727,946 | 5/1903 | Hermanson | 24/133 |
| 2,775,076 | 12/1956 | Roods | 51/170 MT |
| 3,375,616 | 4/1968 | Scott et al. | 51/170 MT |
| 3,533,193 | 10/1970 | Dudek et al. | 51/170 MT |

*Primary Examiner*—James L. Jones, Jr.
*Attorney, Agent, or Firm*—Michael J. Striker

[57] ABSTRACT

A power sander includes a casing bounding a space in which a sanding plate is mounted for cyclical motion in parallelism with a plane of a support surface of the sanding plate. A sanding element, such as sandpaper, is supported on and covers the support surface of the sanding plate, and a clamping arrangement clamps the sanding element to the sanding plate. The clamping arrangement is mounted on the sanding plate for pivoting between an engaging and an disengaging position, and is biased toward the engaging position thereof. An actuating arrangement is mounted in a transverse wall of the casing for displacement between a retracted and an extended position and is operative for abutting against and displacing the clamping arrangement toward the disengaging position thereof during the movement of the actuating arrangement toward the extended position thereof. The actuating arrangement has an actuating portion which is accessible from the exterior of the casing, and a cam portion which engages an abutment surface of the clamping arrangement during the displacement of the actuating arrangement toward the extended position. The actuating arrangement may be arrested at least in the extended position thereof to thereby retain the clamping arrangement in the disengaged position during the exchange of the sanding element. Air may be withdrawn from the space bounded by the casing so as to remove dust resulting from the sanding operation from the vicinity of the sanding plate.

8 Claims, 5 Drawing Figures

POWER SANDER

BACKGROUND OF THE INVENTION

The present invention relates to a power sander, and more particularly to a sander which has a sanding plate which conducts movements in parallelism with a support surface thereof, and in which a plurality of sanding elements, such as sandpaper elements, can be interchangeably mounted on the sanding plate so as to be supported on and cover the support surface of the sanding plate.

There are already known various types of the sanders of the type here under consideration, and in most of such constructions of sanders a clamping arrangement is mounted on the sanding plate for pivoting between an engaging and a disengaging position, the clamping arrangement being urged toward the engaging position thereof in which a clamping portion of the clamping arrangement clamps the sanding element to the sanding plate. As long as the clamping arrangement is readily accessible to the user of the sander, no problems arise with exchanging a worn-out sanding element for a fresh one, or with exchanging a sanding element for a different sanding element of a different coarseness.

However, such sanders in which the clamping arrangement is readily accessible suffer of an important disadvantage which is to be seen in the fact that the access of the user of the sander to the clamping arrangement must not be impeded by various parts of the sander, such as a casing which surrounds the sanding plate and prevents dust produced during the sanding operation from being freely discharged into the ambient atmosphere.

In order to prevent such discharge of the sanding dust into the ambient atmosphere, it has already been proposed to provide a casing which surrounds the sanding plate at all sides thereof except for the support surface thereof which casing, together with the surface being acted upon by the sander, bound an almost completely enclosed space from which it is difficult for the dust to escape. It has been further proposed to maintain the interior of the casing at a subatmospheric pressure, whereby air is drawn through the gap between the casing and the surface which is acted upon so that the dust originating during the sanding operation is effectively prevented from escaping outwardly of the casing, is entrained in the air flowing through the gap, and is withdrawn from the interior space of the casing and accumulated in a storage receptacle to be later discarded. Usually, the sanders of this type include a cover plate which extends parallel to the sanding plate, and a collar-shaped element which circumferentially surrounds the sanding plate with spacing therefrom. In such sanders, the collar-shaped element is detachably mounted on the cover plate, the primary reason for detachably mounting the collar-shaped element on the cover plate being the fact that the collar-shaped element must be removed in order to gain access to the clamping arrangement whenever a sanding element is to be exchanged for a different one. In addition to the disadvantage which results from the need for removing the collar-shaped element prior to exchange of the sanding element, and for reattaching the collar-shaped element after the exchange of the sanding element, a further disadvantage is to be seen in the fact that the space between the cover plate and the sanding plate is usually very small, so that it is rather difficult to pivot the clamping arrangement into the disengaging position thereof against the force of a relatively strong spring which urges the clamping arrangement toward the clamping or engaging position thereof.

SUMMARY OF THE INVENTION

Accordingly, it is a general object of the present invention to avoid the disadvantages of the prior-art sanders.

More particularly, it is an object of the present invention to provide a sander of the type in which the sanding plate is accommodated in the interior space of a casing, in which the casing need not be disassembled prior to exchange of a sanding element and reassembled thereafter.

Still another object of the present invention is to provide a sander of the type here under consideration which is simple in construction and reliable in operation.

It is a concomitant object of the present invention to provide an arrangement for interchangeably attaching a sanding element to the sanding plate, which is easily accessible and simple to operate despite the accommodation of the sanding plate in the casing.

Yet another object of the present invention is to provide an attaching arrangement for use in sanders, which can be arrested in the disengaging position thereof.

In pursuance of these objects and others which will become apparent hereafter, one feature of the present invention resides, briefly stated, in a power sander, in a combination which comprises support means including a casing having an axis, a circumferential wall surrounding the axis with spacing therefrom and having axially spaced ends, and a transverse wall at one of the ends of the circumferential wall, the circumferential and transverse walls bounding a space; a sanding body accommodated in the space and having a support surface at the other end of the circumferential wall; and drive means mounted on the support means and operative for cyclically moving the sanding body in a plane which is normal to the above-mentioned axis. The currently preferred embodiment of the present invention further includes means for interchangeably attaching a sanding element to the sanding body so that the former is supported on and covers the support surface of the sanding body, the attaching means including a clamping arrangement which is mounted on the sanding body for pivoting between an engaging and a disengaging position, biasing means which urges the clamping arrangement toward the engaging position, and actuating means which is mounted on the transverse wall of the casing for displacement between a retracted position and an extended position and which is operative for abutting against and pivoting the clamping arrangement toward the disengaging position during displacement of the actuating means toward the extended position.

In a currently preferred embodiment of the present invention, the clamping arrangement includes a clamping portion which is adapted to clamp the sanding element, such as sandpaper, between itself and the sanding body, such as a sanding plate, and an abutment portion which extends into the path of displacement of a cam portion of the actuating means and is located to the other side of the pivot, on which the clamping arrangement is supported for pivoting, from the clamping portion. It is also proposed by the present invention to provide an arresting arrangement which arrests the actuating means in the extended position thereof so that the actuating means is capable of retaining the clamping arrangement in the disengaging position thereof. The actuating means further includes an actuating portion which is accessible from the exterior of the casing so that the actuating means can be displaced between the retracted and extended positions thereof without any need for disassembling the casing The particular advantage of this arrangement is to be seen in the fact that it is sufficient to displace the actuating means from the exterior of the casing, without any need for disassembling the casing which surrounds the sanding plate, in order to pivot the clamping arrangement between the engaging and the disengaging positions thereof. Thus, not only is there no need for the user of the sander to remove the collar-shaped element of the casing from the transverse wall or cover plate, but also the need for pivoting the clamping arrangement by reaching into the relatively narrow space between the cover plate and the sanding plate is eliminated.

In one of the currently preferred embodiments of the present invention, the actuating means includes a shifting pin arrangement which is mounted in a bore provided in the cover plate for displacement in direction substantially normal to the plane of the support surface of the sanding plate. In this arrangement, it is advantageous to provide an arresting arrangement intermediate the bore provided in the cover plate and the shifting pin arrangement, which arresting arrangement arrests the shifting pin arrangement in the retracted and also in the extended position thereof. It is further advantageous if a spring is arranged between the cover plate and the shifting pin arrangement, which spring urges the shifting pin arrangement toward its retracted position. A currently preferred embodiment of the arresting arrangement for the shifting pin arrangement includes an arresting pin which is so supported in the shifting pin as to extend substantially transversely of the longitudinal axis of the latter, whereby the end portions of the arresting pin extend radially outwardly of the outer circumference of the shifting pin. At least one of the free end portions of the arresting pin is then guided in a slot extending parallel to the bore and in communication therewith so that the free end portion of the arresting pin is guided in the slot during the movement of the shifting pin between the retracted and extended position thereof, abuts against an end portion of the slot in the retracted position of the shifting pin, and abuts against an end surface bounding the bore in the cover plate upon leaving the guide slot and upon rotation of the shifting pin about its longitudinal axis.

In another currently preferred embodiment of the present invention, the actuating arrangement is constructed as a two-armed lever which is supported in an opening of the cover plate for pivoting about an axis which is parallel to the external surface of the cover plate for pivoting between the retracted position and the extended position thereof. One of the arms of the two-armed lever is accessible from the exterior of the casing and is movable between two positions in each of which it extends outwardly of the casing, the other arm of the two-armed lever being constructed as a cam which abuts against and cooperates with an abutment surface of the clamping arrangement. When the two-armed lever is in its retracted position, the lever closes the opening provided in the cover plate in order to prevent leakage of air through the opening into the space between the cover plate and the sanding plate. In order to secure the two-armed lever in the retracted position thereof, an arresting arrangement is advantageously provided between the two-armed lever and the opening of the cover plate. The arresting arrangement can be so constructed that at least one outwardly bulging projection is provided on the two-armed lever, the projection being so mounted on the two-armed lever as to be elastically yieldable. The surface of the cover plate which bounds the opening in which the two-armed lever is mounted is then provided with at least one depression in which the projection of the two-armed lever can be accommodated when the two-armed lever is in the retracted position thereof. The cam portion of the actuating arrangement can be so constructed that, when the two-armed lever is in the extended position thereof, the clamping arrangement is already beyond the most displaced disengaged position thereof.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DISCUSSION OF THE PREFERRED EMBODIMENTS

Figure 1:
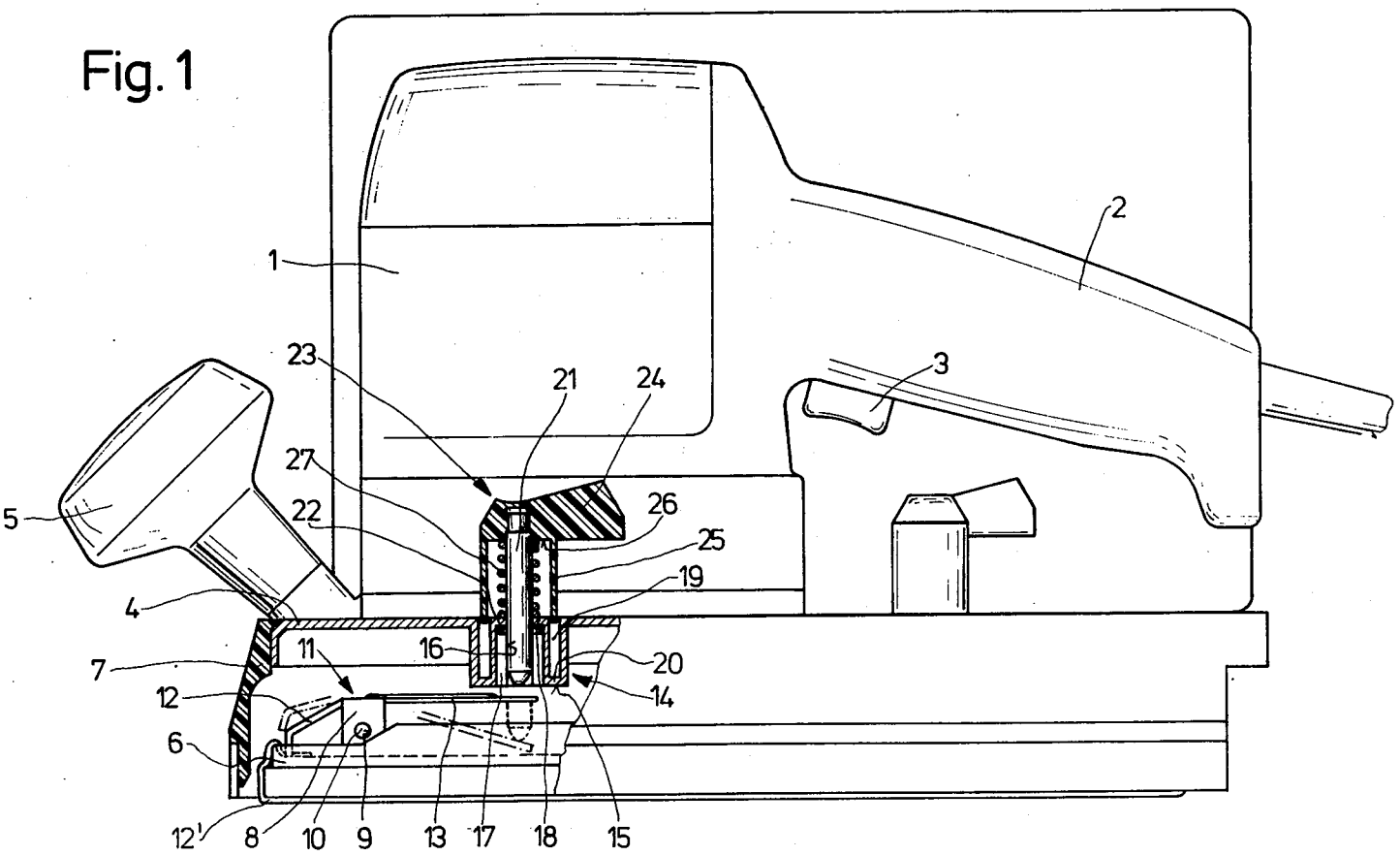
FIG. 1 is a partially sectioned side elevational view of a sander with a first embodiment of the arresting arrangement.

Referring now to the drawings in general, it may be seen that the power sander of the present invention includes a motor housing 1 which is provided with a handgrip portion 2 in which a trigger 3 is mounted. An auxiliary handgrip portion 5 is mounted on a cover plate 4 in a region thereof which is spaced from the handgrip portion 2. A generally rectangular sanding plate 6 is mounted on the cover plate 4 for movement relative thereto. A collar-shaped sealing element 7 is mounted on the cover plate 4 and bounds therewith an interior space in which the sanding plate 6 is accommodated.

A pair of bearing elements 8 is connected to the sanding plate 6 at the narrow marginal portion thereof, each of the bearing elements being formed with a bore 9. A shaft 10 is supported in the bearing elements 8 and extends through the bore 9 thereof, and a clamping bracket 11 is mounted on the shaft 10 for pivoting about the same. The clamping bracket 11 is constructed as a two-armed lever and has a clamping portion 12 and a free abutment portion 13. A non-illustrated conventional spring urges the clamping bracket 11 toward the engaging position thereof which is illustrated in the drawings in full lines. The clamping portion 12 is so configurated that it abuts against the upper major surface of the sanding plate 6 as seen in the drawings. The free abutment portion 13 of the clamping bracket 11 extends substantially horizontally toward the center of the sanding plate 6. Sanding element 12', such as sanding paper, can be clamped between the clamping portion 12 of the clamping bracket 11 and the upper major surface of the sanding plate 6.

Figure 2:
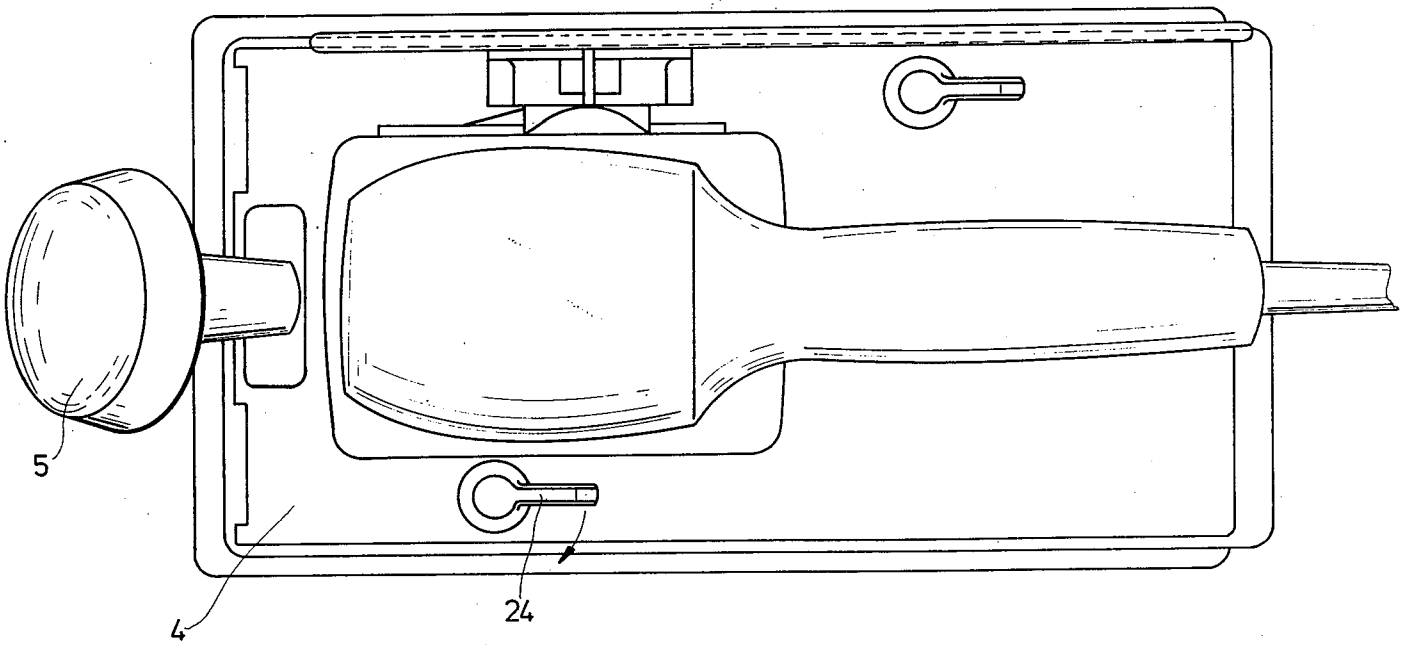
FIG. 2 is a top plan view of the sander of FIG. 1.

Referring now particularly to FIGS. 1 and 2, it may be seen that a generally cylindrical extension 14 is formed on the cover plate 4 in registry with the free abutment portion 13 of the clamping bracket 11. The extension 14 has a planar limiting surface 15 and a central bore 16. The extension 14 is further formed with a slot 17 which communicates with the bore 16, which slot 17 is bounded, at a small distance from the outer surface of the cover plate 4, by a surface 18. A recess 19 surrounds the bore 16 and also the slot 17, the recess 19 being formed in the extension 14 and surrounding a cylindrical jacket. The recess 19 is bounded, at a small distance from the limiting surface 15 of the extension 14, by a wall 20.

A cylindrical shifting pin 21 is guided in the bore 15, and an arresting pin 22 is supported in the lower third of the shifting pin 21 and extends transversely of the shifting pin 21 and radially outwardly beyond its outer circumference. Both radially projecting free ends of the arresting pin 22 are guided in the slot 17. The end of the shifting pin 21 is connected to an actuating portion 23, such as by being roughened, and the actuating portion 23, which may be of an elastically yieldable material, such as synthetic plastic material, being pressure-fitted over the roughened portion of the shifting pin 21. The actuating portion 23 may have a projection 24 which facilitates rotation of the actuating portion 23. The actuating portion 23 further includes a tubular portion 25 which is received in the recess 19 of the extension 14. The tubular portion 25 defines a chamber in which a helical spring 27 is accommodated, one end of which abuts against the cover plate 4, and the other end abutting against a limiting surface 26 which bounds the internal chamber of the actuating element 23.

When it is desired to exchange the sanding element 12' for a different one, the shifting pin 21 is displaced towards its extended position which is illustrated in broken lines in FIG. 1 by exertion of pressure on the actuating portion 23 which is sufficient to overcome the force of the helical spring 27, and also the force of the non-illustrated spring which urges the clamping bracket 11 towards its engaging position, so that the free abutment portion 13 of the clamping bracket 11, and thus also the clamping portion 12 of the latter, are displaced into the position illustrated in dash-dotted lines in FIG. 1. In the fully extended position of the shifting pin 21, the arresting pin 22 leaves the slot 17, whereby the shifting pin is free to rotate about its longitudinal axis. When the shifting pin 21 is so rotated, using the actuating portion 23 and the projection 24 thereof, the arresting pin 22 does not register any longer with the slot 17. Thus, when the actuating portion 23 is released in such angularly displaced position of the shifting pin 21, the helical spring 27 urges the actuating portion 23 toward the retracted position thereof so that the arresting pin 22 abuts against the limiting surface 15 of the extension 14 and prevents displacement of the shifting pin 21 into its retracted position. In this manner, the shifting pin 21 is arrested in the extended position thereof, and retains the clamping bracket 11 in its disengaging position.

Upon exchange of the sanding element 12' for a different one, the shifting pin can be again rotated into a position in which the arresting pin 22 is aligned with the slot 17 so that, when the actuating portion 23 is released, the spring 27 displaces the shifting pin 21 into its retracted position. In this manner, the clamping bracket 11 is released so that the non-illustrated spring forces the clamping bracket 11 into its engaging position in which the clamping portion 12 of the clamping bracket abuts against the upper surface of the sanding plate 6 or against the new sanding element 12' interposed between the clamping portion 12 and the upper surface of the sanding plate 6.

Figure 3:
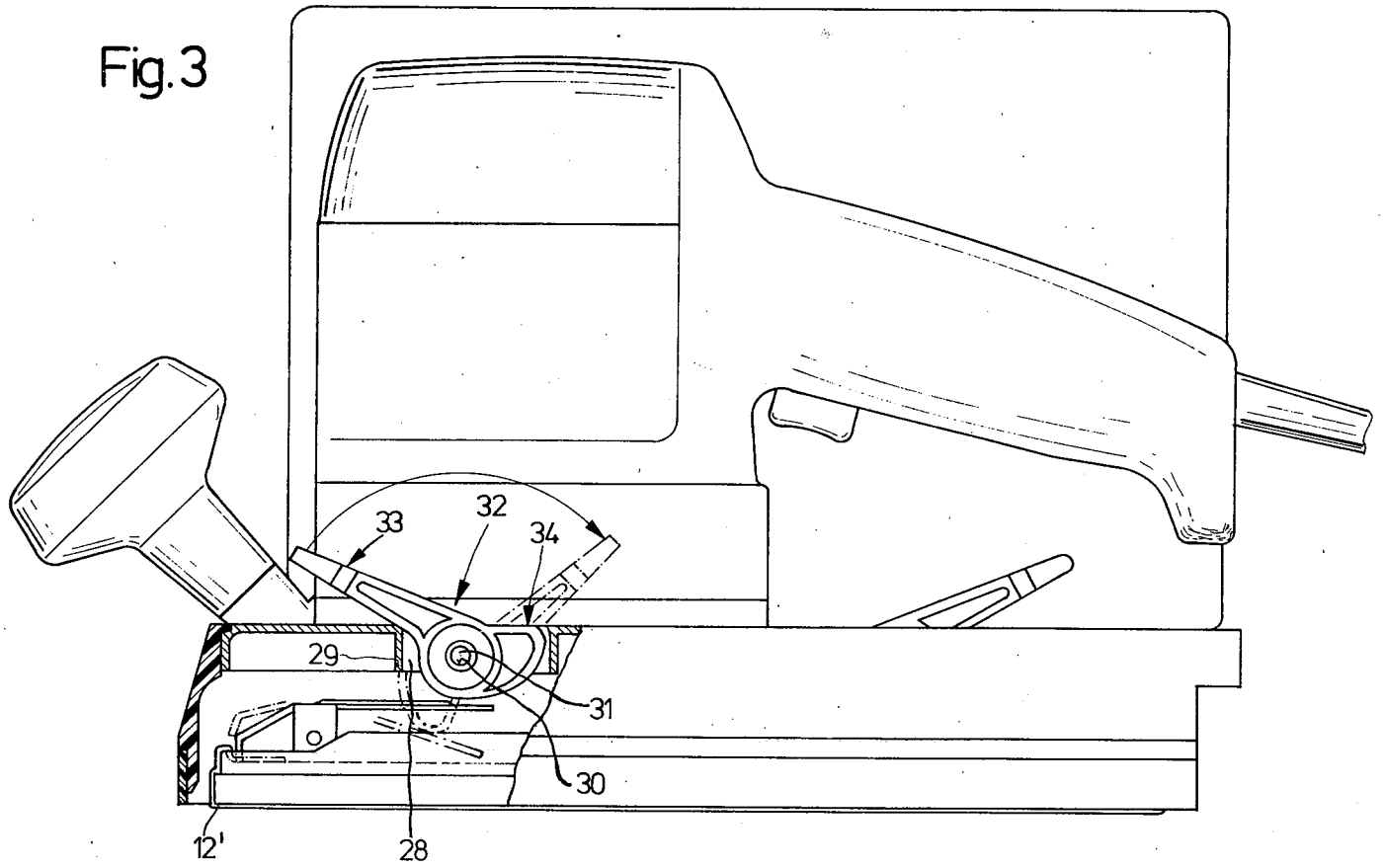
FIG. 3 is a view similar to FIG. 1 illustrating a different embodiment of the actuating arrangement.
Figure 4:
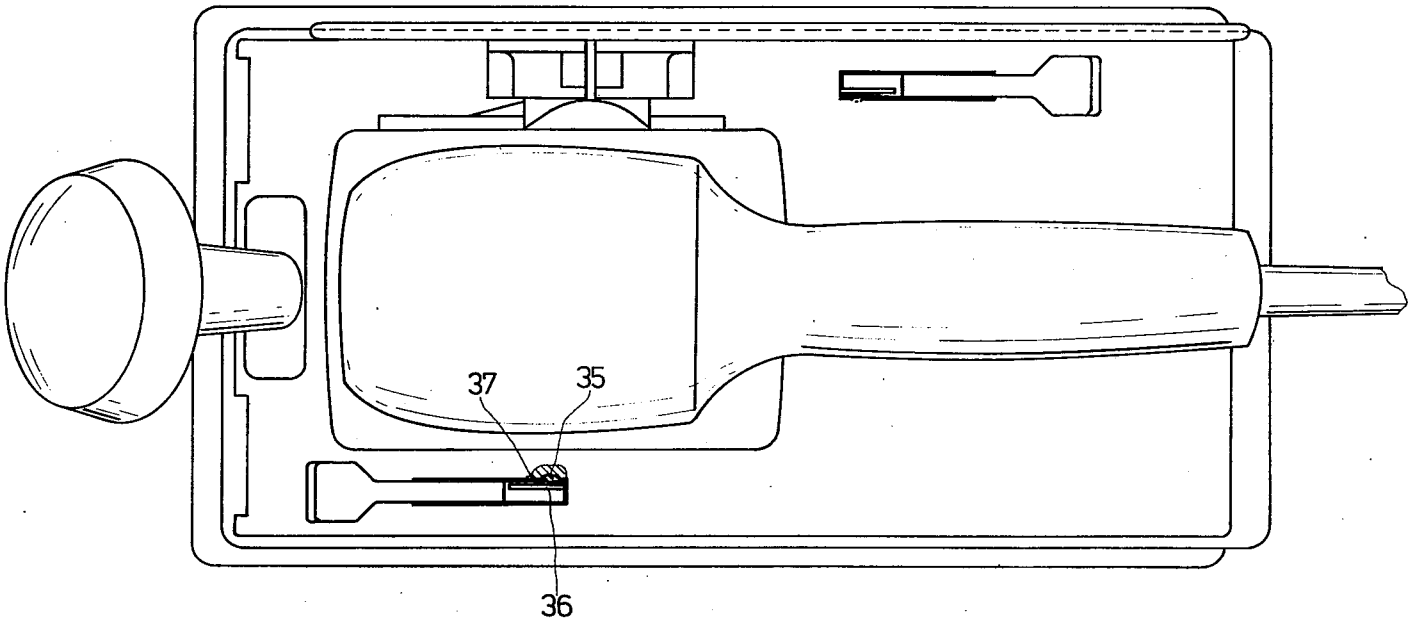
FIG. 4 is a side elevational view of the embodiment illustrated in FIG. 3.

Coming now to the embodiment illustrated in FIGS. 3 and 4, it may be seen that a generally rectangular opening 28 is provided in the cover plate 4 above the free abutment portion 13 of the clamping bracket 11, which opening 28 is surrounded by a collar-shaped marginal portion 29. Two openings 30 are formed in the marginal portion 29, and a shaft 31 is accommodated in the openings 30. A two-armed lever 32 is mounted on the shaft 31, and includes a free actuating portion 33 which is accessible from the exterior of the sander. The two-armed lever 32 further includes a cam portion 34 which is accommodated in the space bounded by the cover plate 4 and the marginal portion 29 thereof. The actuating lever 32 and the cam portion 34 thereof are so constructed that, when the actuating lever 32 is in the retracted position thereof which is illustrated in FIG. 3 in full lines, the cam portion 34 and the actuating portion 33 of the actuating lever 32 almost completely close the opening 28.

The cam portion 34 is formed, in a lateral region thereof, with an outwardly bulging projection 35, and has a longitudinal slot 36 in the region laterally offset from the projection 35. In this manner, the outwardly bulging projection 34 is connected with the remainder of the cam portion 34 is an elastically yieldable manner. A depression 37 is formed in the marginal portion 29 which surrounds the opening 28 of the cover plate 4, in the region of the path of movement of the outwardly bulging projection 35. Thus, when the actuating lever 32 is in its retracted position, the outwardly bulging projection 35 is received in the depression 37 and thus the cam portion 34, together with the remainder of the actuating lever 32, is arrested in the retracted position thereof, The cam surface of the cam portion 34 which faces and cooperates with the free abutment portion 13 of the clamping bracket 11 is so configurated that, when the actuating portion 33 of the actuating lever 32, and thus the cam portion 34 thereof, is displaced toward the extended position thereof, the cam surface of the cam portion 34 abuts against the free abutment portion 13 of the clamping bracket 11, thus pivoting the clamping bracket 11 toward the disengaging position thereof. The cam surface of the cam portion 34 is so shaped that, when the actuating lever 32 assumes its fully extended position illustrated in dash-dotted lines in FIG. 3, the free abutment portion 13 has already reached and partially returned from the fully disengaging position thereof. In this manner, the force with which the free abutment portion 13 of the clamping bracket 11 acts on the cam portion 34 of the actuating lever 32 urges the latter toward its extended position and thus the actuating lever 32 retains the clamping bracket 11 in its disengaging position illustrated in dash-dotted lines in FIG. 3.

While the present invention has been discussed in connection with only one clamping lever 11 and one actuating arrangement cooperating therewith, it is to be understood that a plurality of such clamping levers and such actuating arrangements may be provided.

The power sanders illustrated in the drawings are, in all other respects, of conventional constructions so that details of conventional components which constitute the sander need not be discussed.

Figure 5:
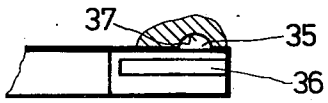
FIG. 5 is an enlarged view of a detail of FIG. 4.

The embodiments of the present invention which are illustrated in FIGS. 1 and 2, on the one hand and in FIGS. 3 to 5, on the other hand, satisfactorily solve the problems which have been enumerated above. The arrangement illustrated in FIGS. 1 and 2 is advantageous in that the cover plate 4 is sealingly closed in the region of the actuating arrangement. A small disadvantage of this particular arrangement is to be seen in the fact that the access to the actuating portion 23 is somewhat inconvenient, particularly because of the presence of the motor housing 1 immediately adjacent to the actuating portion 23 and the projection 24 thereof.

The embodiment illustrated in FIGS. 3 to 5 avoids this disadvantage; however, the actuating lever 32 cannot be absolutely sealingly received in the opening 28 of the cover plate 4, so that a small amount of air will be drawn into the interior of the casing constituted by the cover plate 4 and the collar-shaped sealing element 7 through the opening 28. However, the amount of false air which is drawn into such interior through the opening 28 is very small so that the effectiveness of the evacuation of the interior space and withdrawal of the sanding dust therefrom is not significantly impaired.

Both of the above-discussed embodiments of the present invention have the advantage that the sanding element 12', such as sandpaper element, can be faultlessly introduced and retained between the clamping portion 12 and the sanding plate 6, without requiring an excessive amount of effort and skill on the part of the user of the power sander. The introduction and the clamping of the sanding element 12' is greatly facilitated by the fact that the clamping bracket 11 can be arrested in the disengaging position thereof, so that the user of the power sander can use both hands for introducing the sandpaper 12' between the clamping portion 12 of the clamping bracket 11 and the upper major surface of the sanding plate 6.

It will be understood that each of the elements described above, or two or more together, may also find a useful application in other types of constructions differing from the types described above.

While the invention has been illustrated and described as embodied in a power sander, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of the prior art, fairly constitute essential characteristics of the generic or specific aspects of this invention.

What is claimed as new and desired to be protected by Letters Patent is set forth in the appended claims.

1. A power sander comprising, in combination, a support means including a casing having an axis, a circumferential wall surrounding said axis with spacing therefrom and having axially spaced ends, and a transverse wall at one of said ends and having at least one opening of predetermined dimensions, said walls bounding a space; a sanding body accommodated in said space and having a support surface at the other end of said circumferential wall; drive means mounted on said support means and operative for cyclically moving said sanding body in a plane which is normal to said axis; means for interchangeably attaching a sanding element to said sanding body so that the former is supported on and covers said support surface, including clamping means mounted on said sanding body for pivoting between an engaging position and a disengaging position, and biasing means urging said clamping means toward said engaging position; and actuating means including at least one actuating lever mounted in said opening of said transverse wall for pivoting about a pivot axis normal to said axis between a retracted position and an extended position and having an actuating portion accessible from the exterior of said casing, and a cam portion in said space which is operative for abutting against and pivoting said clamping means toward said disengaging position durng pivoting of said actuating lever toward said extended position, said actuating lever having such dimensions as to close said opening in said retracted position thereof to thereby prevent air from passing through said opening past said actuating lever during the operation of the sander.

2. A combination as defined in claim 1, wherein said casing and said sanding body bound with one another a dust-removing passage commencing at said other end of said circumferential wall and extending past said opening and confining a stream of air at subatmospheric pressure during the operation of the sander; and wherein said actuating lever in said retracted position thereof prevents penetration of ambient air into said passage through said opening.

3. A combination as defined in claim 1, wherein said clamping means includes a clamping bracket having a clamping portion operative for clamping the respective sanding element to said sanding body, and an abutment portion extending into the path of displacement of said cam portion toward said extended position.

4. A combination as defined in claim 1, and further comprising arresting means for arresting said actuating means at least in said extended position thereof.

5. A combination as defined in claim 1, and further comprising arresting means for arresting said actuating lever in one of said positions thereof.

6. A combination as defined in claim 5, wherein said arresting means includes at least one outwardly bulging projection which travels in a path during displacement of said actuating lever between said positions thereof, and at least one depression in said transverse wall within said path, which is of complementary shape to said projection and adapted to receive the latter in one of said positions of said actuating lever.

7. A combination as defined in claim 6, wherein said projection is elastically yieldable relative to said actuating lever.

8. A combination as defined in claim 1, wherein said cam portion has a cam surface which travels in a path during displacement of said actuating lever between said positions thereof, said cam surface abutting against an abutment surface of said clamping means and being so configurated that said clamping means is slightly retracted from the fully disengaging position thereof when said actuating lever is in said extended position thereof, whereby said actuating means retains said clamping means in said disengaging position of the latter.

* * * * *